US009772105B2

(12) United States Patent
Tzavaras

(10) Patent No.: US 9,772,105 B2
(45) Date of Patent: Sep. 26, 2017

(54) APPARATUS FOR OPTIMIZING HYDROCARBON COMBUSTION

(76) Inventor: Ilias Tzavaras, Regina (CA)

( * ) Notice: Subject to any disclaimer, the term of this patent is extended or adjusted under 35 U.S.C. 154(b) by 720 days.

(21) Appl. No.: 13/992,337

(22) PCT Filed: Dec. 7, 2010

(86) PCT No.: PCT/IB2010/003132

§ 371 (c)(1),
(2), (4) Date: Aug. 11, 2014

(87) PCT Pub. No.: WO2012/076914

PCT Pub. Date: Jun. 14, 2012

(65) Prior Publication Data

US 2015/0004550 A1 Jan. 1, 2015

(51) Int. Cl.

| | |
|---|---|
| ***F23C 99/00*** | (2006.01) |
| ***F02M 27/04*** | (2006.01) |
| ***F23K 5/08*** | (2006.01) |
| ***F02M 27/06*** | (2006.01) |

(52) U.S. Cl.

CPC ..... *F23C 99/001* (2013.01); *F02M 27/04* (2013.01); *F02M 27/06* (2013.01); *F23K 5/08* (2013.01); *F23K 2301/101* (2013.01)

(58) Field of Classification Search

CPC ..... F02M 1/00

USPC ..... 431/2, 253

See application file for complete search history.

(56) References Cited

U.S. PATENT DOCUMENTS 4,203,398 A * 5/1980 Maruoka ..... F02D 41/18 123/538
4,337,746 A * 7/1982 Masaki ..... F02D 41/1441 123/691
4,359,989 A * 11/1982 Masaki ..... F02D 41/144 123/438
4,574,627 A * 3/1986 Sakurai ..... G01N 27/417 204/412

* cited by examiner

*Primary Examiner* — Avinash Savani

(57) ABSTRACT

A device for optimizing hydrocarbon combustion has at least one dipole antenna comprising first and second wires extending in opposite directions. At least one power source, can supply the wires with voltages which are intermittent, alternating and sinusoidal, said voltages being between 2,000 V to 100,000 V and having frequencies between 30 KHz and 1 MHz. The voltage in the second wire is opposite and balanced to the voltage in the first wire. When the dipole antenna is placed parallel and in close proximity to a hydrocarbon supply, an electromagnetic field acts on the hydrocarbon to enhance combustion of the hydrocarbon. An apparatus including the device and a method of using the device to optimize hydrocarbon combustion are also provided.

58 Claims, 5 Drawing Sheets

APPARATUS FOR OPTIMIZING HYDROCARBON COMBUSTION

This invention is in the field of devices for the enhancement of hydrocarbon combustion, and more specifically devices for the enhancement of hydrocarbon combustion by electromagnetic radiation.

BACKGROUND

Inefficient burning of hydrocarbon fuels has many negative consequences. With the existence of only a limited amount of hydrocarbon fuels and the high cost of these fuels to a consumer, it is desirable to try to conserve as much of these resources as possible.

In addition to the economic benefits to hydrocarbon conservation, the combustion of hydrocarbon fuels are harmful to the environment—when hydrocarbons are not burned completely, residual hydrocarbons are expelled through an exhaust pipe or chimney, which wastes energy and money, and furthermore pollutes the environment. This atmospheric pollution is a key contributor to the concept of global warming which is of great concern to people around the world. Provision of a method or apparatus for the more efficient combustion of hydrocarbons which would reduce atmospheric pollution would be desirable in an environmental context.

In addition to the benefits which could be gained environmentally from the burning of hydrocarbon fuels a higher fuel to energy conversion efficiency, there will also be economic benefits. In addition to residual material discharge into the environment, low efficiency hydrocarbon combustion can also leave behind residue in the combustion engine which requires additional maintenance or could shorten the life of that equipment. Reducing wear and tear on the engine or other apparatus in which those fuels are being burned, by enhancing hydrocarbon combustion, would also be desirable insofar as it would decrease maintenance.

Many different attempts have been made in the past to develop products which can be used to increase the efficiency at which hydrocarbon fuels are burned. A number of these devices use an electric field which acts on hydrocarbon fuels to help the fuel burn more efficiently. Other devices have attempted to enhance the efficiency of hydrocarbon combustion using the magnetic field of permanent magnets, claiming that applying a permanent magnetic field to hydrocarbon fuels immediately before combustion in some fashion alters the fuels electrical properties and increases the efficiency of combustion. Some examples of prior patents in the field of permanent magnets used in this fashion include U.S. Pat. Nos. 4,572,145, 3,830,621 and 5,080,080.

Other devices apply an electrostatic charge to the fuel at the nozzle of the fuel injector before combustion, reducing the viscosity of the fuel by imparting a negative charge onto the individual atoms. When this happens, the atoms repel each other making the fuel less viscous. As the viscosity is lower, when a fuel injector injects the fuel to be burned, the fuel breaks up into smaller particles and burns more completely. The drawback with these devices is that they require a specific fuel injector that can be difficult and expensive to install.

Some of the problems which are associated with these previous electric or magnetic devices which could be installed in a motor vehicle for example to endeavor to enhance hydrocarbon combustion efficiency include difficulties with installation as well as the complexity of the device itself. On the point of installation, many electric or magnetic devices might use coils or cables to produce the electric or magnetic field which is required for operation of the device, and the installation of coils or cables in the pre-existing engine compartment or on fuel lines etc. can be difficult or complex requiring professional-service work to be done in the vehicle and potentially decreasing the marks of acceptance or acceptability of those products. It would be desirable to provide, in the context of an electromagnetic combustion optimization device, a device which could be easily and quickly installed by the owner in a motor vehicle or on some other internal combustion engine. In addition to internal combustion engines, any other application in which hydrocarbon fuels are burned could be enhanced similarly.

SUMMARY OF THE INVENTION

It is an object of the present invention to provide an electromagnetic radiation treatment device to enhance the combustion of hydrocarbon fuels that will enhance internal combustion or other energy combustion applications performance by moving towards optimized hydrocarbon combustion, and will reduce gas emissions.

It is a further object of the present invention to provide an electromagnetic radiation treatment device to enhance hydrocarbon fuel combustion in an internal combustion engine or other energy combustion application or device, which is simple to install without the need for the use of a skilled technician. Specifically it is desired to provide a device which requires only the installation of two cables for its functionality and does not employ any magnet or electromagnet, or coil. Reduction of the complexity of components which need to be installed with this type of a device will represent a significant installation enhancement over the prior art.

A power supply is attached to the hydrocarbon combustion optimizer device to provide the hydrocarbon combustion optimizer device with electric power. The power supply could be an electrical power supply, a battery etc. In an embodiment, an apparatus for the treatment of hydrocarbon fuels comprises a hydrocarbon combustion optimizer device containing electronic components which produce a specific frequency between 30 KHz and 1 MHz of two balanced alternating opposite sinusoidal high voltages between 2,000V to 100,000V. The voltages are intermittent, alternating, and sinusoidal. The intermittency of the applied alternating voltage can have a period of 1 second to 1 microsecond, and the duration is from 100 milliseconds to 1 microsecond. Also attached to the hydrocarbon combustion optimizer device are two wires that constitute a dipole antenna, which is situated close to a supplying hydrocarbon fuel pipe or storage tank.

A method for optimizing the combustion of hydrocarbon fuels comprises providing an hydrocarbon combustion optimizer device containing electronic components which produce a specific frequency between 30 KHz and 1 MHz of two alternating opposite sinusoidal balanced high voltages between 2,000V to 100,000V. The voltages are intermittent, alternating, and sinusoidal. The intermittency of the applied alternating voltage can have a period of 1 second to 1 microsecond, and the duration is from 100 milliseconds to 1 microsecond. A power supply is attached to the hydrocarbon combustion optimizer device to provide the hydrocarbon combustion optimizer device with electric power. Also attached to the hydrocarbon combustion optimizer device is a dipole antenna which is situated close to a supplying hydrocarbon fuel pipe or storage tank.

In operation, a user installs the hydrocarbon combustion optimizer device for treatment of hydrocarbon fuels. The user attaches the hydrocarbon combustion optimizer device to a power supply (power supply, battery etc.), mounts device body and positions the dipole antenna close to a supplying hydrocarbon fuel pipe or storage tank. In a circumstance where more than one supply pipe or fuel stream was present or used in a combustion application, more than one dipole antenna could be attached to the device and each attached in proximity to one of such pipes or hydrocarbon supply streams—alternatively, the antenna could be attached in proximity to the fuel storage tank or reservoir to eliminate the need for use of more than one antenna. The simplicity of the installation of the device can be seen.

The length of the wires constituting the dipole antenna will depend on the specific electromagnetic frequency produced by the hydrocarbon combustion optimizer device. When electric power is flowing from the power supply (battery, power supply etc.) to the hydrocarbon combustion optimizer device, the components in the hydrocarbon combustion optimizer device will produce a specific frequency between 30 KHz and 1 MHz of two balanced alternating opposite sinusoidal high voltages of between 2,000V to 100,000V in the dipole antenna. The voltages are intermittent, alternating, and sinusoidal. The magnitude of the alternating voltages on the dipole antenna will depend on the type of hydrocarbon being used, the quantity of the hydrocarbon, and the speed that the hydrocarbon fuel travels through the fuel stream, if a fuel stream is present (if a flowing fuel stream is not present or the combustion application or engine is deactivated, the device could or would be disconnected or shut off).

The generated frequencies are stable, clear of harmonics, and the frequency depends on the type of hydrocarbon fuel. The intermittency of the applied alternating voltage can have a period of 1 second to 1 microsecond, and the duration is from 100 milliseconds to 1 microsecond. The intermittency will be dependent on the type of hydrocarbon fuel, the quantity, and the speed that it streams through the supplying pipe, if a supplying pipe is present, or through the storage reservoir or tank as the case may be.

The present invention provides a device and method useful in reducing the amount of greenhouses gases emitted by virtue of inefficient hydrocarbon combustion. The present invention is designed to be environmentally friendly and easy for a consumer to install without the need for an experienced or skilled technician.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

The general concept of the present invention is to provide a device which will apply an electromagnetic field to hydrocarbon fuel. The application of two alternating high voltages in close proximity to the hydrocarbon fuel stock create an electromagnetic field that acts on the hydrocarbon fuel in the fuel stream or fuel storage tank. The applied electromagnetic field modifies the properties of the hydrocarbon isomers, resulting in the reduction of pollutants and in a higher fuel to energy conversion efficiency. The application of an electromagnetic field imposing on hydrocarbon molecules a high voltage electrostatic space charge has the ability to change the behaviour of the hydrocarbon molecules through oxidation, radicalization, or positional isomerism. Modifying these properties of the isomers enables a more uniform reaction during combustion, substantially reducing the likelihood of unburned or partially burned fuel.

Figure 1:
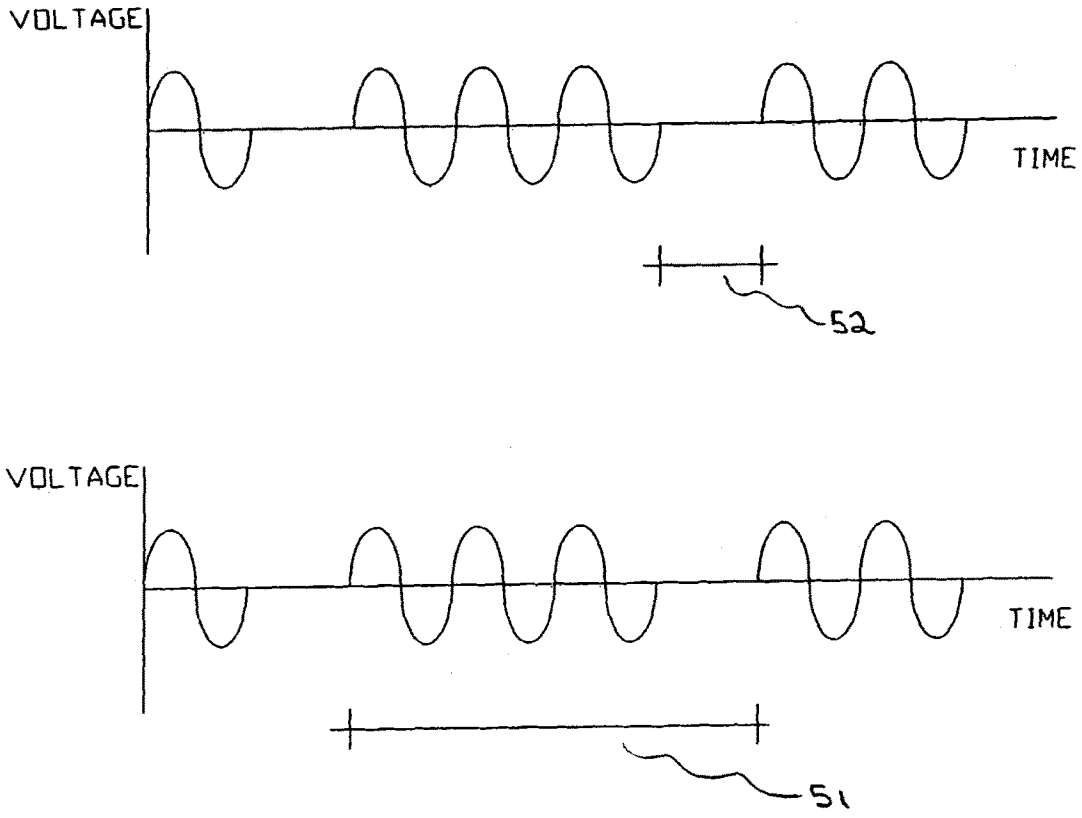
FIG. 1 is a voltage pattern diagram shown for the purposes of demonstration of the voltages intended for use in the production of a dipolar electromagnetic field, and specifically to show the period of the voltages and the duration of the intermittency.

Referring to FIG. 1 for the purpose of outlining the voltage wave pattern of the present invention, the voltage is intermittent, alternating, and sinusoidal. The generated frequencies are stable, clear of harmonics, and the frequency depends on the type of hydrocarbon fuel. The specific frequency is between 30 KHz and 1 MHz of voltages between 2,000V to 100,000V. The intermittency of the applied alternating voltage can have a period 51 of 1 second to 1 microsecond, and the duration 52 is from 100 milliseconds to 1 microsecond.

Figure 2:
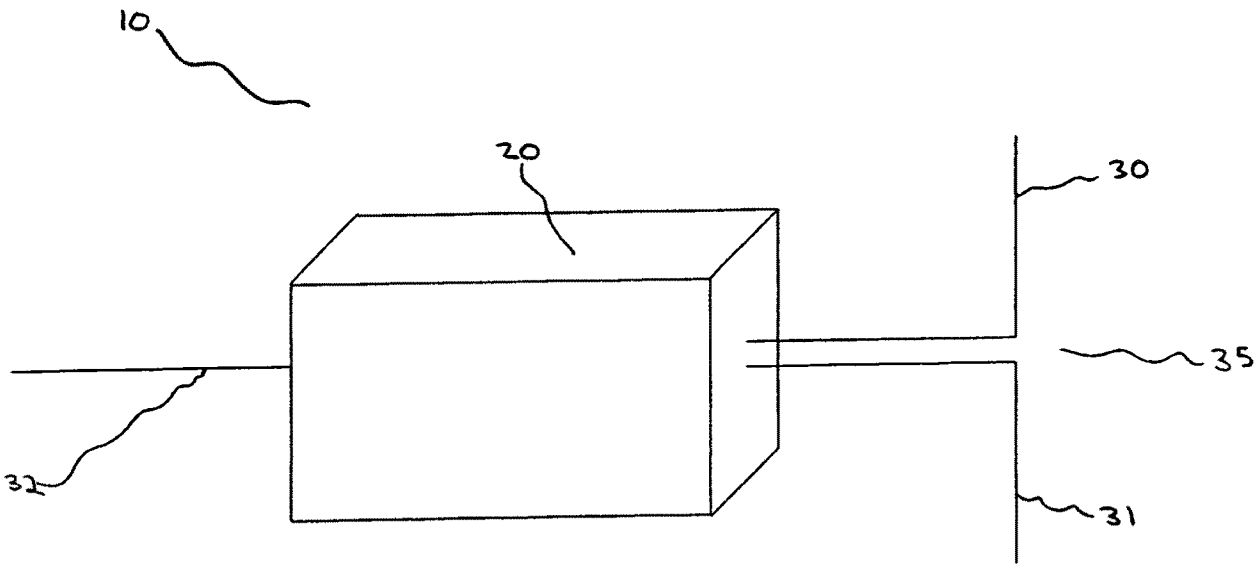
FIG. 2 is a side perspective view of one embodiment of the hydrocarbon combustion optimizer of the invention.

Device:

FIG. 2 illustrates a hydrocarbon combustion optimizer 10 in an embodiment of the present invention. The hydrocarbon combustion optimizer device body 20 contains electronic components which produce a specific frequency between 30 KHz and 1 MHz of two balanced alternating opposite sinusoidal high voltages between 2,000V to 100,000V. The voltages are intermittent, alternating, and sinusoidal. The intermittency of the applied alternating voltage can have a period of 1 second to 1 microsecond, and the duration is from 100 milliseconds to 1 microsecond.

Figure 3:
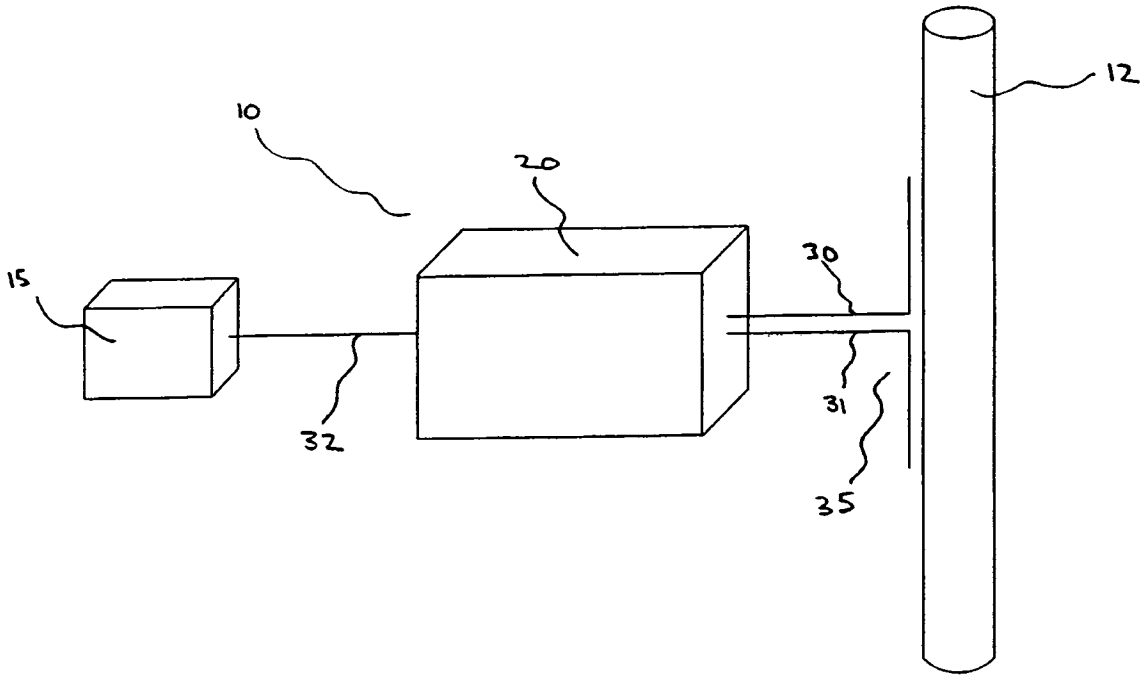
FIG. 3 is a perspective view of the embodiment of FIG. 2, also showing the attachment of a power supply to the device and installed for use on a fuel supply pipe.

Also attached to the hydrocarbon combustion optimizer device body 20 are two wires 30 and 31 that constitute a dipole antenna 35. The two wires 30 and 31 are equal in length. The dipole antenna 35 is situated close to a hydrocarbon fuel supply or stream—in this particular case, FIG. 3 illustrates the hydrocarbon combustion optimizer 10 installed for use on a fuel supplying pipe 12, by placement of the dipole antenna 35 in proximity to the fuel supply pipe 12.

Figure 4:
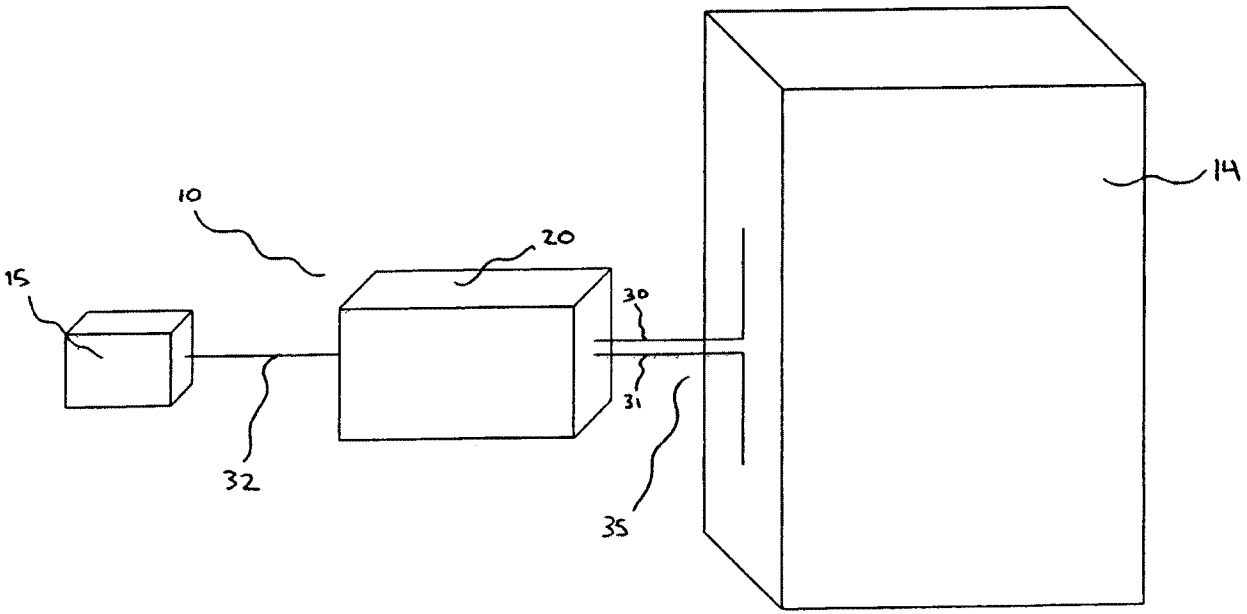
FIG. 4 is a side perspective view of the embodiment of FIG. 2 installed for use on a fuel storage tank.

FIG. 4 illustrates the hydrocarbon combustion optimizer 10 of FIG. 2, installed for use on a fuel storage tank 14 rather than a fuel supply pipe. The embodiment shown in this Figure also includes a power supply 15. As outlined elsewhere herein, the power supply 15 might be any electrical power supply, battery etc. capable of providing the necessary power to the electrical components of the device 10 for its operation in accordance with the remainder of this specification. The power supply 15 is attached to the hydrocarbon combustion optimizer device body 20 to provide the hydrocarbon combustion optimizer device body 20 with electric power. Cables or wires 32 attaching the power supply 15 to the remainder of the device 10 are shown in FIG. 3 and FIG. 4.

Circuitry:

In addition to the overall hydrocarbon combustion optimizer 10 of the present invention and the method used disclosed herein, it will also be understood that contemplated within the present invention is the actual circuit which would be used within the hydrocarbon combustion optimizer 10 to convert or transform the power supply 15 into the alternating sinusoidal waveform voltages which are required for application to the dipole antenna 35 and the remainder of the device and method of the present invention.

Method of Installation and Use:

To use the device 10, a user positions the dipole antenna 35 close to a hydrocarbon fuel supply, and verifies the connection or operability of the power supply 15. It is anticipated within the scope of the invention that an LED or other indicator can be utilized to verify the operability and a working connection to the power supply. The user ensures that the first wire 30 and the second wire 31 extend in opposite directions to each other, and are placed parallel and in close proximity to the fuel stream or supply.

Figure 5:
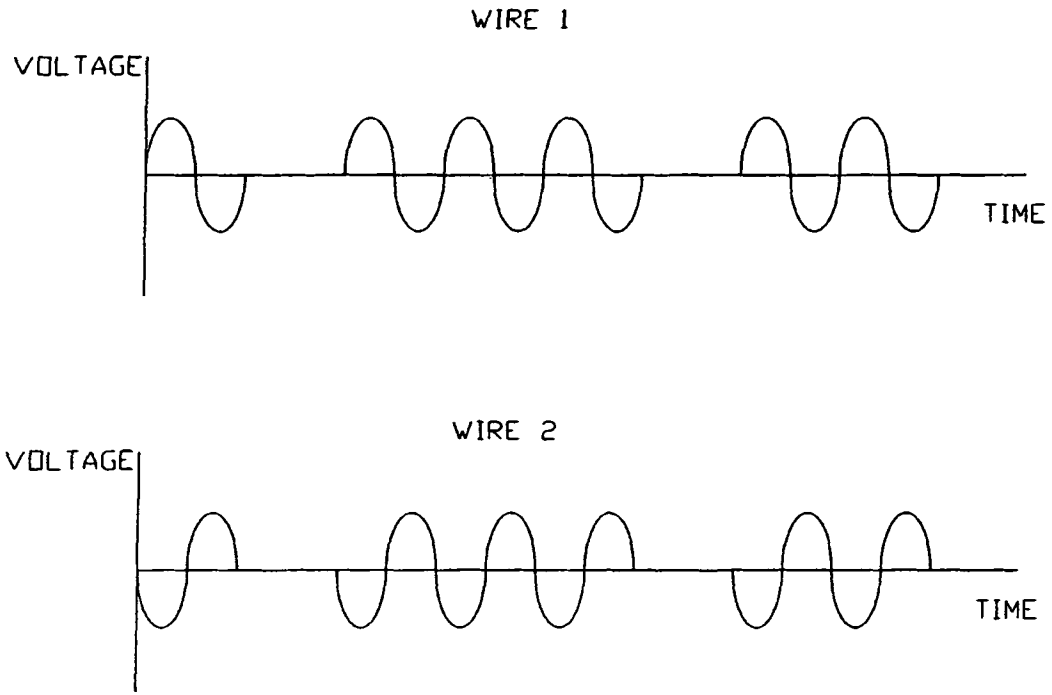
FIG. 5 is a diagram of the voltage patterns in each of the wires constituting the dipole antenna.

When electric power is flowing from the power supply 15 to the hydrocarbon combustion optimizer device body 20, the electronic components in the device body 20 produce a specific frequency between 30 KHz and 1 MHz of two balanced alternating opposite sinusoidal high voltages of voltage between 2,000V to 100,000V in the dipole antenna 35, as shown in FIG. 3 and FIG. 4. The voltages are intermittent, alternating, and sinusoidal, as shown in FIG. 5. The length of the wires 30 and 31 constituting the dipole antenna 35 will depend on the produced specific frequency of the hydrocarbon combustion optimizer device body 20. The magnitude of the applied dipole alternating voltages will depend on the type of hydrocarbon being used, the quantity of the hydrocarbon, and the speed that the hydrocarbon fuel travels through the fuel stream/tank 14/supply pipe 12.

Referring again to FIG. 1, the generated frequencies are stable, clear of harmonics, and the frequency depends on the type of hydrocarbon fuel. The intermittency of the applied alternating voltage can have a period 51 of 1 second to 1 microsecond, and the duration 52 is from 100 milliseconds to 1 microsecond. The intermittency will be dependent on the type of hydrocarbon fuel, the quantity, and the speed that it streams through the supplying pipe 12, if a supplying pipe 12 is present. The hydrocarbon combustion optimizer 10 can be permanently installed in this manner, and the installation process is simple and can be installed without the need for a skilled or experienced technician.

The two alternating high voltages create an electromagnetic field that acts on the hydrocarbon fuel in the fuel stream 12 or fuel storage tank 14. The applied electromagnetic field modifies the properties of the hydrocarbon isomers and participates fully in the combustion process, resulting in the reduction of pollutants and in a higher fuel to energy conversion efficiency. This action on the molecules of the hydrocarbon fuel imposes a high voltage electrostatic space charge so as to change the positional isomerism of the hydrocarbon molecules. The high voltage electrostatic space charge has the ability to change the behaviour of the molecules through oxidation, radicalization, or positional isomerism. Modifying these properties of the isomers enables a more uniform reaction during combustion, substantially reducing the likelihood of unburned or partially burned fuel.

It will also be understood that the method of enhancing hydrocarbon combustion by the application of an electromagnetic field in close proximity to the fuel source in an internal combustion application or any other energy or combustion application in which combustion of hydrocarbon fuels takes place, as outlined above, is contemplated within the scope hereof.

The method of installation of the device 10 would ideally require only the straightforward mounting of a dipole antenna 35 in close proximity to the hydrocarbon source with at most the need for installation of two cables used as an antenna. As will be understood from elsewhere in this document, the electromagnetic field is generated by the application of alternating sinusoidal waveform voltages between 2000 V and 100,000 V at alternating frequencies between 30 kHz and 1 MHz.

Variations in Waveform Patterns:

It will be understood also by those skilled in the art that while the balanced alternating sinusoidal waveform voltages applied to the two sides of the dipole antenna 35 would be valued each between 2000 V and 100,000 V, the waveform voltages applied may not be the same value on either side i.e. while it is possible to apply the same voltage to each side of the dipole antenna 35, in certain applications it may be desirable to apply different waveforms, or voltages to the two sides of the antenna 35. Each such approach is contemplated within the scope hereof.

Similarly, while it is contemplated that the sinusoidal voltage frequencies on either side of the dipole antenna 35 would be between 30 kHz and 1 MHz, again those frequencies might either be the same or may not be the same dependent upon the application in question and all the necessary modifications to the method and components outlined herein to accomplish the objective of rendering a dipole antenna 35 with voltages variable or varied, and stable frequencies that can be varied, on either side of the antenna 35 are contemplated within the scope of the present invention in addition to the more basic embodiment in which the voltage or frequency would be the same on either side thereof.

As in the case of the voltages or frequencies, it will similarly be understood the intermittent period of the alternating voltages on the dipole antenna 35 would be between 1 μs and one second. The duration of the intermittent period could also be the same or different on the two sides of the dipole antenna 35 and the voltages in question, where the intermittent period on either side could have a duration between 100 ms to 1 μs.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A device for optimizing hydrocarbon combustion, the device comprising:

a. at least one dipole antenna comprising a first wire extending in a first direction and a second wire extending in a second direction opposite the first direction;

b. a first power supply operative to supply the first wire with a first voltage which is intermittent, alternating and sinusoidal, said first voltage being between 2,000 V to 100,000 V and having a frequency between 30 KHz and 1 MHz; and c. a second power supply to supply the second wire with a second voltage, said second voltage being between 2,000 V to 100,000 V and having a frequency between 30 KHz and 1 MHz, and wherein the second voltage is opposite and balanced to the first voltage;

wherein when the at least one dipole antenna is placed parallel and in close proximity to at least one hydrocarbon supply, an electromagnetic field acts on the at least one hydrocarbon supply to enhance combustion of the at least one hydrocarbon supply.

2. The device of claim 1 wherein the first power supply and the second power supply are a single unitary power supply supplying voltage to both the first wire and the second wire.

3. The device of claim 1 wherein the first power supply and the second power supply are separate power supplies, which are separately controllable for the independent supply of voltage to the first and second wires.

4. The device of claim 1 wherein the first wire and the second wire are substantially equal in length.

5. The device of claim 1 wherein the first wire and the second wire are not equal in length.

6. The device of claim 1 wherein the absolute amplitude of the first voltage is substantially equal to that of the second voltage.

7. The device of claim 1 wherein the absolute amplitude of the first voltage differs from that of the second voltage.

8. The device of claim 1 wherein the waveform of the first voltage and the second voltage are each sinusoidal and substantially clear of harmonics.

9. The device of claim 6 or 7 wherein the first voltage and the second voltage have opposite waveforms.

10. The device of claim 1 wherein the frequency of the first voltage differs from the frequency of the second voltage.

11. The device of claim 1 wherein the intermittent period of the first and second alternating voltages is between 1 second and 1 microsecond.

12. The device of claim 1 wherein the duration of the first and second voltages is from 100 milliseconds to 100 nanoseconds.

13. The device of claim 1 wherein the first power supply is an electric power supply.

14. The device of claim 1 wherein the first power supply is a battery.

15. The device of claim 1 wherein the second power supply is an electric power supply.

16. The device of claim 1 wherein the second power supply is a battery.

17. The device of claim 1 wherein the number of dipole antennae is one.

18. The device of claim 1 wherein the number of dipole antennae is more than one.

19. The device of claim 1 wherein the at least one hydrocarbon supply comprises at least one hydrocarbon fuel pipe.

20. The device of claim 1 wherein the at least one hydrocarbon supply comprises at least one hydrocarbon storage tank.

21. A method of optimizing hydrocarbon combustion, the method comprising the steps of:

a. providing at least one dipole antenna comprising a first wire extending in a first direction and a second wire extending in a second direction opposite the first direction;

b. placing the at least one dipole antenna parallel and in close proximity to at least one hydrocarbon supply; and c. operating a first power supply to supply the first wire with a first intermittent, alternating sinusoidal voltage between 2,000 V to 100,000 V having a frequency between 30 KHz and 1 MHz, and operating a second power supply to supply the second wire with a second voltage that is between 2,000 V to 100,000 V having a frequency' between 30 KHz and 1 MHz.

22. The method of claim 21 wherein the first power supply and the second power supply are a single unitary power supply supplying voltage to both the first wire and the second wire.

23. The method of claim 21 wherein the first power supply and the second power supply are separate power supplies, which are separately controllable for the independent supply of voltage to the first and second wires.

24. The method of claim 21 wherein the first wire and the second wire are substantially equal in length.

25. The method of claim 21 wherein the first wire and the second wire are not equal in length.

26. The method of claim 21 wherein the absolute amplitude of the first voltage is substantially equal to that of the second voltage.

27. The method of claim 21 wherein the absolute amplitude of the first voltage differs from that of the second voltage.

28. The method of claim 21 wherein the waveform of the first voltage and the second voltage are each sinusoidal and substantially clear of harmonics.

29. The method of claim 21 wherein the first voltage and the second voltage have opposite waveforms.

30. The method of claim 21 wherein the frequency of the first voltage differs from the frequency of the second voltage.

31. The method of claim 21 wherein the intermittent period of the first and second alternating voltages is between 1 second and 1 microsecond.

32. The method of claim 21 wherein the duration of the first and second voltages is from 100 milliseconds to 100 nanoseconds.

33. The method of claim 21 wherein the first power supply is an electric power supply.

34. The method of claim 21 wherein the first power supply is a battery.

35. The method of claim 21 wherein the second power supply is an electric power supply.

36. The method of claim 21 wherein the second power supply is a battery.

37. The method of claim 21 wherein the number of dipole antennae is one.

38. The method of claim 21 wherein the number of dipole antennae is more than one.

39. An apparatus for optimizing hydrocarbon combustion, the device comprising:

a. At least one hydrocarbon source;

b. at least one dipole antenna comprising a first wire extending in a first direction and a second wire extending in a second direction opposite the first direction;

c. a first power supply operative to supply the first wire with a first voltage which is intermittent, alternating and sinusoidal, said first voltage being between 2,000 V to 100,000 V and having a frequency between 30 KHz and 1 MHz; and d. a second power supply to supply the second wire with a second voltage, said second voltage being between 2,000 V to 100,000 V and having a frequency between 30 KHz and 1 MHz, and wherein the second voltage is opposite and balanced to the first voltage;

the at least one dipole antenna being placed in parallel close proximity to at least one hydrocarbon supply such that an electromagnetic field acts on the at least one hydrocarbon supply to enhance combustion of the at least one hydrocarbon supply.

40. The apparatus of claim 39 wherein the first power supply and the second power supply are a single unitary power supply supplying voltage to both the first wire and the second wire.

41. The apparatus of claim 39 wherein the first power supply and the second power supply are separate power supplies, which are separately controllable for the independent supply of voltage to the first and second wires.

42. The apparatus of claim 39 wherein the first wire and the second wire are substantially equal in length.

43. The apparatus of claim 39 wherein the first wire and the second wire are not equal in length.

44. The apparatus of claim 39 wherein the absolute amplitude of the first voltage is substantially equal to that of the second voltage.

45. The apparatus of claim 39 wherein the absolute amplitude of the first voltage differs from that of the second voltage.

46. The apparatus of claim 39 wherein the waveform of the first voltage and the second voltage are each sinusoidal and substantially clear of harmonics.

47. The apparatus of claim 39 wherein the first voltage and the second voltage have opposite waveforms.

48. The apparatus of claim 39 wherein the frequency of the first voltage differs from the frequency of the second voltage.

49. The apparatus of claim 39 wherein the intermittent period of the first and second alternating voltages is between 1 second and 1 microsecond.

50. The apparatus of claim 39 wherein the duration of the first and second voltages is from 100 milliseconds to 100 nanoseconds.

51. The apparatus of claim 39 wherein the first power supply is an electric power supply.

52. The apparatus of claim 39 wherein the first power supply is a battery.

53. The apparatus of claim 39 wherein the second power supply is an electric power supply.

54. The apparatus of claim 39 wherein the second power supply is a battery.

55. The apparatus of claim 39 wherein the number of dipole antennae is one.

56. The apparatus of claim 39 wherein the number of dipole antennae is more than one.

57. The apparatus of claim 39 wherein the at least one hydrocarbon supply comprises at least one hydrocarbon fuel pipe.

58. The apparatus of claim 39 wherein the at least one hydrocarbon supply comprises at least one hydrocarbon storage tank.

* * * * *